US006286270B1

(12) United States Patent
Gruson et al.

(10) Patent No.: US 6,286,270 B1
(45) Date of Patent: Sep. 11, 2001

(54) BAR ANCHOR AND METHOD FOR REINFORCING STEEL IN CONCRETE CONSTRUCTION

(76) Inventors: Paul Gruson, Rietgors 15, 5221 HH, Engelen; Anionius M. Kies, Oranjelaan 8, 5026 KA, Oisterwijk, both of (NL)

( * ) Notice: Subject to any disclaimer, the term of this patent is extended or adjusted under 35 U.S.C. 154(b) by 0 days.

(21) Appl. No.: 09/270,881

(22) Filed: Mar. 17, 1999

Related U.S. Application Data

(60) Provisional application No. 60/078,926, filed on Mar. 20, 1998.

(51) Int. Cl.[7] ..... E02D 5/80

(52) U.S. Cl. ..... 52/155; 52/156; 52/165; 52/740.1; 52/740.3; 52/740.5

(58) Field of Search ..... 52/155, 156, 165, 52/740.1, 740.3, 740.5, 740.6

(56) References Cited

U.S. PATENT DOCUMENTS

| | | | | |
|---|---|---|---|---|
| 2,127,973 | | 8/1938 | Isett . | |
| 2,781,658 | * | 2/1957 | Dobell | 52/740.1 X |
| 4,034,567 | * | 7/1977 | Roggen | 61/35 |
| 4,397,589 | * | 8/1983 | Darroussin et al. | 52/155 X |
| 4,619,096 | | 10/1986 | Lancelot, III . | |
| 4,926,785 | * | 5/1990 | Lamson | 116/209 |
| 5,131,204 | | 7/1992 | Hiendl . | |
| 5,457,918 | * | 10/1995 | Plourde | 52/165 X |
| 5,571,229 | * | 11/1996 | Fitzsimmons et al. | 52/165 X |
| 5,662,304 | * | 9/1997 | McDaniel | 52/165 X |
| 5,729,952 | * | 3/1998 | Dahl | 52/740.1 X |
| 6,048,344 | * | 4/2000 | Schenk | 606/73 |
| 6,056,751 | * | 5/2000 | Fenton, Jr. | 606/72 |
| 6,062,263 | * | 5/2000 | Donovan et al. | 138/89 |
| 6,070,299 | * | 6/2000 | Schnelle | 16/382 |

FOREIGN PATENT DOCUMENTS

| | | | | |
|---|---|---|---|---|
| 43703 | * | 1/1935 | (AU) | 52/740.5 |
| 0 088 825 A2 | | 11/1982 | (EP) . | |
| 0 158 944 A2 | | 4/1985 | (EP) . | |
| 0 230 542 A1 | | 11/1986 | (EP) . | |
| 375373 | * | 5/1907 | (FR) | 52/737 |
| WO 95/10672 | | 4/1995 | (WO) . | |

OTHER PUBLICATIONS

ERICO® LENTON® FORM SAVER™ literature, 1990.
ERICO® LENTON® TERMINATOR™ literature, 1990.

* cited by examiner

*Primary Examiner*—Carl D. Friedman
*Assistant Examiner*—Phi Dieu Tran A
(74) *Attorney, Agent, or Firm*—Renner, Otto, Boisselle & Sklar, LLP

(57) ABSTRACT

An anchor used in concrete construction serves both as a bar termination and as a transition or starter bar anchor for use between pours or at forms for poured-in-place construction, or at the surfaces of precast elements. The anchor includes a core and is of relatively short axial extent, which has substantial peripherally continuous deformations which provide a large area bonding surface relative to the diameter or area of the core. In a preferred form, the increased bonding surface area is created by a circumferentially continuous flute or ridge which has a substantial height relative to the core. In a preferred form, the ridge is the form of a continuous helix. The height of the rib is preferably about ⅓ the axial spacing or pitch. The core includes bar sockets at one or both ends which may be designed to accommodate bar ends for a variety of mechanical connections, although tapered thread connections are preferred.

11 Claims, 4 Drawing Sheets

BAR ANCHOR AND METHOD FOR REINFORCING STEEL IN CONCRETE CONSTRUCTION

DISCLOSURE

This application is a Continuation of a Provisional Application Ser. No. 60/078,926, filed Mar. 20, 1998.

This invention relates generally as indicated to a bar anchor and method, and more particularly to an anchor and method having wide application in the design and construction of steel reinforced concrete, whether constructed as poured-in-place, or as precast components.

BACKGROUND OF THE INVENTION

One of the most commonly used components in steel reinforcing for concrete construction, other than the bar, is a bar anchor. A common form of bar anchor is simply a bent or hooked bar end. The hook may be a 90° or a 180° bend. Typically, the hook forms the end of a bar. The hook may be embedded in a wall or column, while the rod projects into a beam or slab, or the hook is simply bent around the corner of a form. The rods may project through a form or into special bend-out boxes where pours are in sequence. More and more, protruding and bent bars are something to avoid for a variety of design, installation, and safety reasons.

Anchors are also widely used in dowel bar splices used in the formation of concrete pavement. The anchors may be straight or hooked sections of rod. The anchor may include a threaded socket which may be integral with or welded to the bar end. An example of the former is seen in U.S. Pat. No. 4,619,096, while an example of the latter is seen in the LENTON® FORM SAVER™ sold by Erico International Corporation of Solon, Ohio, USA. LENTON® is a registered trademark of Erico.

The threaded socket of the FORM SAVER™ includes a plate permitting the anchor to be attached to the inside of a form. After the concrete is cast and the form removed, the socket is available to enable a bar to be attached. If the threads are tapered, the attachment is with a few turns. Most such anchors include bent bar ends.

Bent or hooked bar ends or anchors have several drawbacks. They usually have to be sizeable to be effective. Also, the bending or rebending of the bar, especially a sharp bend, is often detrimental to the strength of the bar. If the anchor is to be placed in a relatively thin wall or column, the bend usually has to form a relatively sharp corner simply to fit. It is not uncommon for poor quality bar to snap, or certainly weaken when subject to such stress. Also, a small radius bend may not be permitted by design codes.

Another type of anchor is that simply using an oversize section of reinforcing bar. The oversize bar requires special treatment, and, unless bent, requires an inordinate length. An example of this type of anchor is seen in U.S. Pat. No. 5,131,204.

Another problem encountered with such anchors is bar congestion. Recent code changes have increased the amount of steel reinforcing required which results in bar congestion. These requirements, coupled with the desire of the owner or designer for more compact structural elements and less dead or unusable space, makes bar congestion a real problem for placement and installation of the bar. For example, it is not uncommon to have a shear wall only 200 mm thick. This greatly adds to the time and cost of installation, or building construction.

To alleviate some of these problems, there has been developed a headed anchor utilizing the principals of the Shear Cone Theory. The end of the bar is provided with a large heavy head. The inside of the head to which the bar is attached forms a theoretical shear cone resisting tension and having a wide transfer base in the concrete. This type of anchor is sold under the trademark LENTON® TERMINATOR™, also by Erico International Corporation of Solon, Ohio, USA. The headed anchor works on the same principal as a headed shear stud. The tip of the shear cone is, however, usually in one or two planes transaxially of the rod or stud. It would be desirable if the anchor would form the shear cones at varying axial locations with substantial area or deformations, and preferably continuously throughout its length, and still be overall of relatively short axial extent.

While the head on the end of the reinforcing bar makes an excellent bar end anchor, it cannot normally be used also as an anchor at a poured-in-place transition face, or at the face of a precast structure, since the hypothetical shear cone has little or no base. It would accordingly be desirable to have an anchor which may serve both as a bar end anchor and as a transition anchor at or near a form face. It would also be desirable to have such an anchor which does not require a hole in the form or a bar protruding through the form.

SUMMARY OF THE INVENTION

A reinforcing bar anchor for steel reinforced concrete construction may be used as a bar anchor or termination, or as a transition anchor between pours, or at forms in poured-in-place construction, or at the surfaces or embedded in precast concrete elements. The anchor includes a core of relatively short axial extent, but which has a transverse dimension which is approximately one and a half to three times the diameter of the bar which is to be anchored. Projecting circumferentially from the core are substantial ribs or deformations providing enhanced and increased bonding area for an anchor embedded in concrete. In one preferred from, there is but a single rib in the form of a continuous helix. In another form, the ribs are axially separate rings. In either form, the rib has a height about ⅓ the spacing or pitch of the ribs or rings. The excess height of the ribs, the substantial spacing, and the axially and circumferentially continuous nature of the deformations enable the anchor to be shorter than would otherwise be required. This provides ease of fitting in thin wall or other small or congested bar sites. The bond based anchoring capacity creates a complex array of load transfers from the steel to the concrete extending throughout the length of the anchor, and does not concentrate the forces in any single plane or location.

Various bar connections to the anchor may be employed, although tapered threads are preferred for reinforcing bar connections. The ribs may be uniform in height and also may vary in height, increasing in height away from the transition face or bar connection. The bar connection may be provided at one or both ends. With the invention a wide variety of terminations or anchors may be employed at various locations including forms or other transitions in poured-in-place and in precast elements, such as bar anchors or combinations, or simply lifting anchors, in precast elements.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
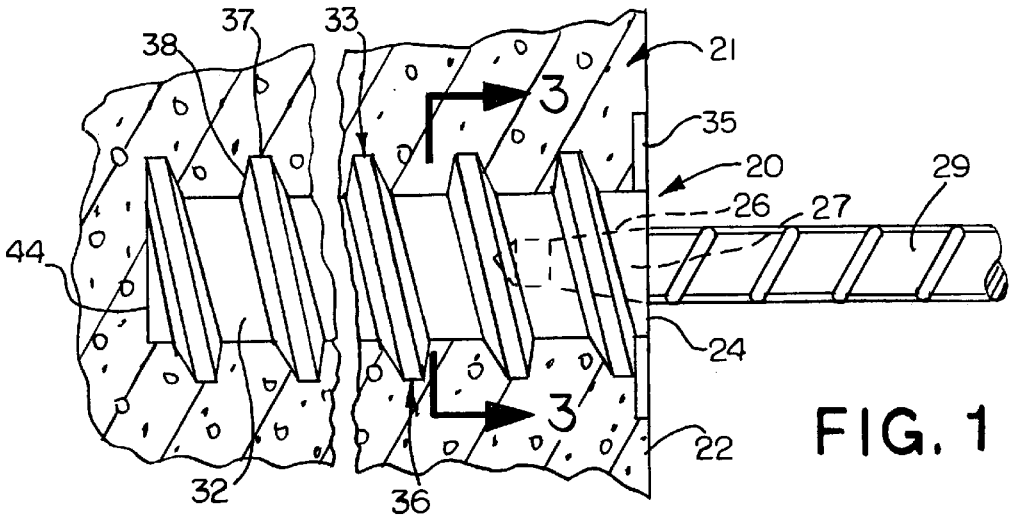
FIG. 1 is a fragmentary section of an anchor in accordance with the invention at a concrete face or transition between pours.

Referring now to FIG. 1, there is illustrated an anchor 20 in accordance with the invention. The anchor is shown embedded in concrete 21 at a transition face 22 which may be formed by a form, not shown, confining the concrete 21 in poured-in-place construction. The form has been removed, and the concrete transition face becomes the form for the next pour. When the form is removed, the end 24 of the anchor 20 is exposed, and such end includes a threaded socket 26 having tapered threads mating with tapered threads 27 on the end of reinforcing bar 29. During the pour, the threaded socket may be protected by a plastic plug or cap which may readily be removed when the forms are removed, exposing a clean internally tapered thread socket for attachment of the bar 29 with a few turns.

The anchor 20 includes a core 32 which has a transverse dimension or diameter about one and a half to about three times the diameter of the bar 29. The exterior of the core is provided with significant deformations indicated at 33 which provide the anchor with a substantial area exterior bond surface. In FIG. 1, the end 24 of the anchor adjacent the form which has been removed, or the end with the tapered thread socket, is provided with a mounting plate 35. The plate may include fastener holes, not shown, to facilitate the attachment of the plate and thus the anchor to the desired location on the inside of the form. The plate also may be shaped as a cone of a certain thickness to form additional shear strength to the transition face of adjoining concrete pours.

Figure 2:
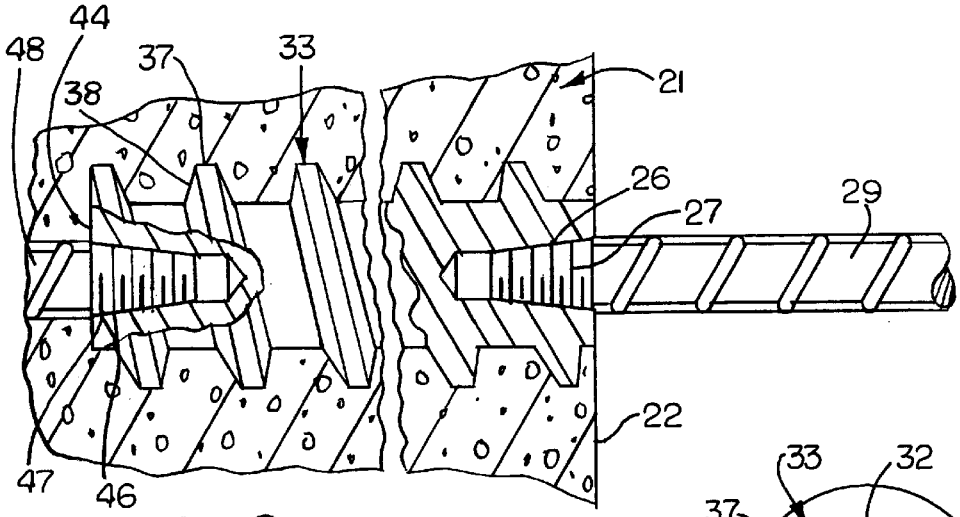
FIG. 2 is a similar illustration further broken away to show a preferred type of threaded connection in this case at both ends of the anchor.
Figure 3:
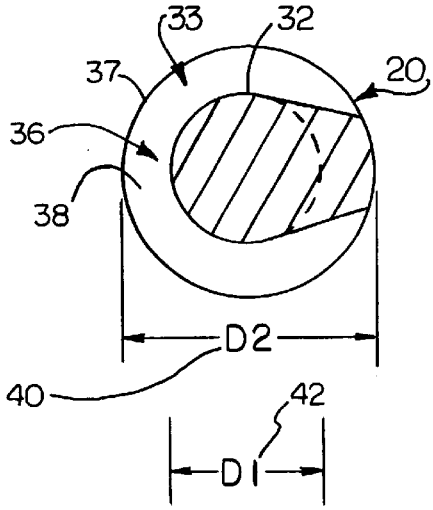
FIG. 3 is a transverse section taken on the line 3—3 of FIG. 1 showing the relationship between the core and overall transverse dimensions of the anchor.

The substantial heavy deformations on the exterior of the anchor in the embodiment of FIGS. 1–3 are obtained by a helical rib or flute 36 which is continuous throughout the length of the anchor. The rib has a flat top or crown 37 and sloping flanks 38. The top or crown may be round or some other shape. The rib continues at a pitch approximately three times the height of the flute or rib to provide a substantial number of continuous turns throughout the axial length of the anchor. As hereinafter described, the number of turns may vary.

Referring now to FIG. 3, it will be seen that anchor includes an exterior dimension or outside diameter indicated by the diameter D2 at 40. The core, however, has a smaller dimension or diameter D1 indicated at 42. As indicated, the core diameter 42 is preferably about one and one-half to about three times the accommodated bar diameter. The core diameter may be on the smaller end of such range using tapered thread bar connections and on the larger end of such range if using straight thread connections or connections utilizing a hardenable filler material as hereinafter described. In the illustrated embodiment shown, the dimension D2 or 40 is substantially larger than Dl or 42, and at such dimensions, the axially facing area of the deformations which is the area of the circle at diameter D2 minus the area of the circle at diameter D1, is considerably larger than the axial area of the core. When multiplied by the number of turns of the major rib or flute, the deformation area facing axially in one direction is substantially larger than the area of the core.

The utilization of a helical rib or flute ensures that no two points along the rib or flute are at the same axial location along the length of the anchor, and that the loads transferred from the anchor to the concrete and vice versa are gradual and continuous, not only circumferentially but throughout the length of the anchor. Not only does the anchor and its deformations provide substantial bonding area in one axial direction, it provides the same area in the opposite axial direction, and resists not only tensile but also compressive loads equally well. In addition to the axially facing areas provided by the deformations, the surfaces at a height-pitch ratio of about one-third (⅓) provide substantial additional bonding surfaces facing in a transaxial direction. The height-pitch ratio may be from about 0.1 to about 0.5, and preferably about 0.3. All of the surfaces of the deformations may be roughened or provided with a smaller deformation pattern, such as knurling, to enhance the bond between the bond deformation surfaces and the concrete.

With the helical flute or rib illustrated, a complex theoretical bond is developed providing a complex conical pencil of lines extending completely circumferentially and axially of the anchor and in both axial directions to resist both tensile and compressive forces.

The illustrations in FIGS. 1 and 3 are but one embodiment, and it will be appreciated that the overall diameter of the anchor may vary, and that the height of the ribs may vary from approximately one-tenth the diameter of the core to more than one-half the diameter of the core, as illustrated. Also, it will be appreciated that the profile of the bond deformations may vary from the profile shown, and that the core may be other than the cylindrical shape shown. Further, the core and overall shape of the anchor need not be cylindrical or round, but may be any polygon shape such as hexagonal, although circular or round is preferred. The core may also contain a hollow center to reduce weight, but concrete paste intrusions need to be kept from entering the threaded socket.

The overall length of the anchor may be approximately a maximum of 160 mm. Concrete walls or shear walls are now being formed which are approximately only 200 mm wide. It will be seen that at 160 mm, an anchor in accordance with the present invention will fit well within the wall permitting a maximum of 40 mm to cover the opposite end 44 of the anchor. It will, of course, be appreciated that for other applications and for varying strengths of concrete, the axial length of the anchor may vary.

In FIG. 1, there is illustrated a threaded socket on one end only of the anchor 20. In FIG. 2, however, there is also provided a threaded socket 46 in the end 44 accomodating the external threads 47 on additional bar 48 which is aligned with the bar 29. If an additional threaded socket is employed in the anchor 20 seen in FIG. 1 in the end face 44, it may simply be filled with concrete if not used. Accordingly, the anchor provided in FIG. 1 is a starter bar anchor for the rod 29. In FIG. 2, the anchor is a connection between the rods 48 and 29 permitting the rod 48 to be continued to the next transition pour without requiring bar to project through or from forms. This application can also be used in case of a future extension of the building. This assures a fully anchored load in rod 48, provides continuity of rods 29 and 48, but also provides load anchoring for both in the concrete or pour 21.

Figure 4:
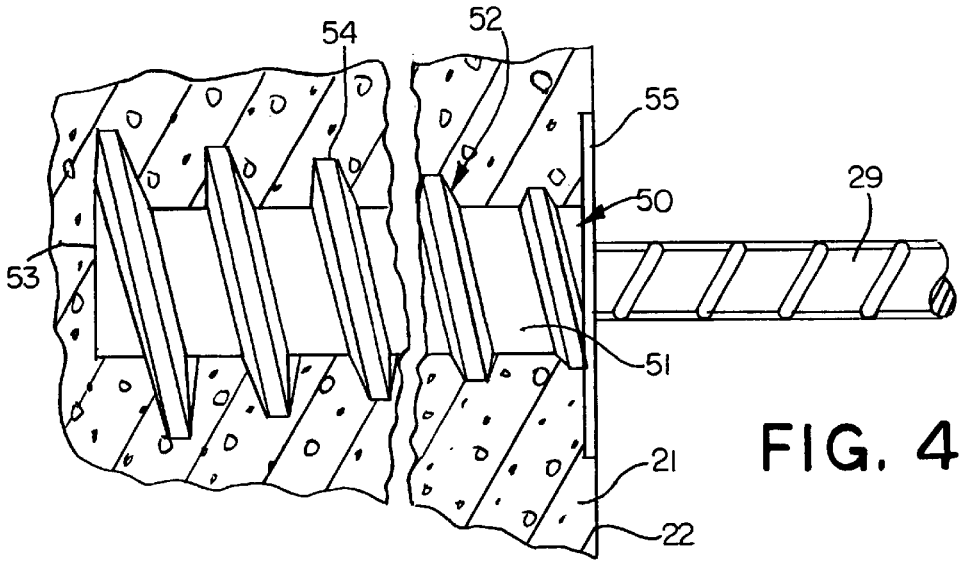
FIG. 4 is a view like FIG. 1 illustrating a further embodiment.

FIG. 4 illustrates another embodiment of the invention where the anchor 50 includes a core 51 provided with a projecting flute or rib 52 in the form of a helix. However, the height of the rib or flute progressively increases at it moves or spirals toward the end 53 of the anchor away from the transition face 22 or bar 29. The rib height at the midpoint shown generally at 54 is approximately the same height as the rib seen in FIG. 1, and accordingly the average rib height may be the same as that shown in FIG. 1, and the area relationships between the core and the overall diameter are substantially the same. It will also be appreciated that the core need not be of uniform transverse dimension. For example, the core may be a cone having its large dimension at the right hand end or mouth as shown. This results in an increased rib height at the opposite or smaller end.

However, the slightly larger rib height at the end 53 away from the form or bar 29 somewhat enhances the theoretical shear cones projecting from that end of the anchor. While FIG. 4 illustrates a uniform increase in the rib height along the axis of the core or anchor, it will be appreciated that a non-uniform increase in height may be employed so that the line connecting the top of each rib axially does not form a cone, but rather a parabolic or hyperbolic surface of involute form. Again, the anchor 50 may be provided with a plate on one end seen at 55 permitting the anchor to be secured quickly to the interior of a form. The bar 29 may be secured to the anchor with the same tapered threaded socket connection.

Figure 5:
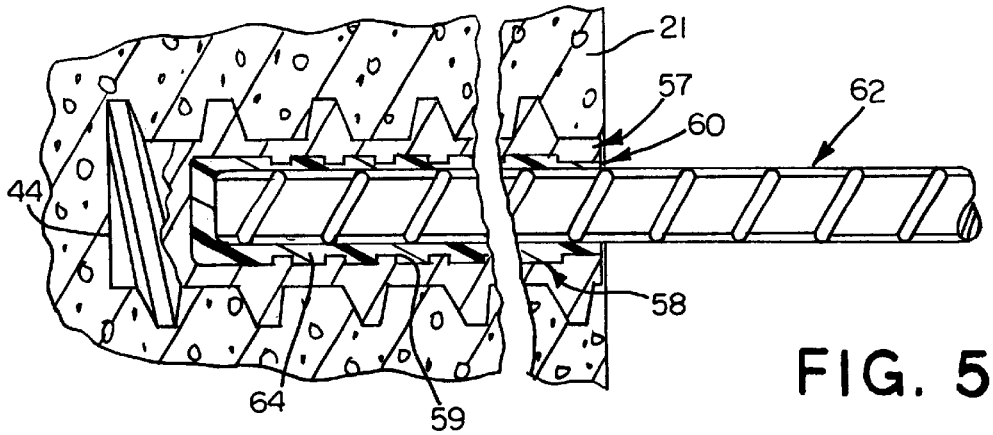
FIG. 5 is also a view like FIG. 1 but illustrating another form of connection between the anchor and bar end.

In FIG. 5, there is illustrated an anchor shown generally at 57 which has the same exterior appearance as the anchor 20 of FIG. 1. However, the anchor 57 has a substantially larger interior socket 58 forming a substantial generally cylindrical cavity having deformations 59 on the interior of the cavity, and a necked entrance opening shown generally at 60. The deformations 59 may be in the form of annular rings or a thread of substantial pitch.

The necked opening 60 may accommodate an expansible plug which seals the anchor interior cavity during the pour of the concrete 21. After the form is removed, the plug may be removed exposing the interior socket 58. A steel reinforcing bar indicated at 62 may then be secured in the socket in the manner illustrated by a hardenable material shown generally at 64. The hardenable material, when it becomes hard, is keyed to the deformations on the bar and interior of the cavity locking the bar and anchor together. FIG. 5 illustrates a plastic material 64 which may typically be in the form of a two part epoxy or a cementitious grout. Other hardenable filler materials may be employed such as cast metal used in the well known CADWELD® reinforcing bar connection. CADWELD® is a registered trademark of Erico International Corporation of Solon, Ohio, USA. Other types of hardenable filler materials may be various types of grout such as those used in connections of the type illustrated in prior U.S. Pat. No. 5,336,672.

Figure 6:
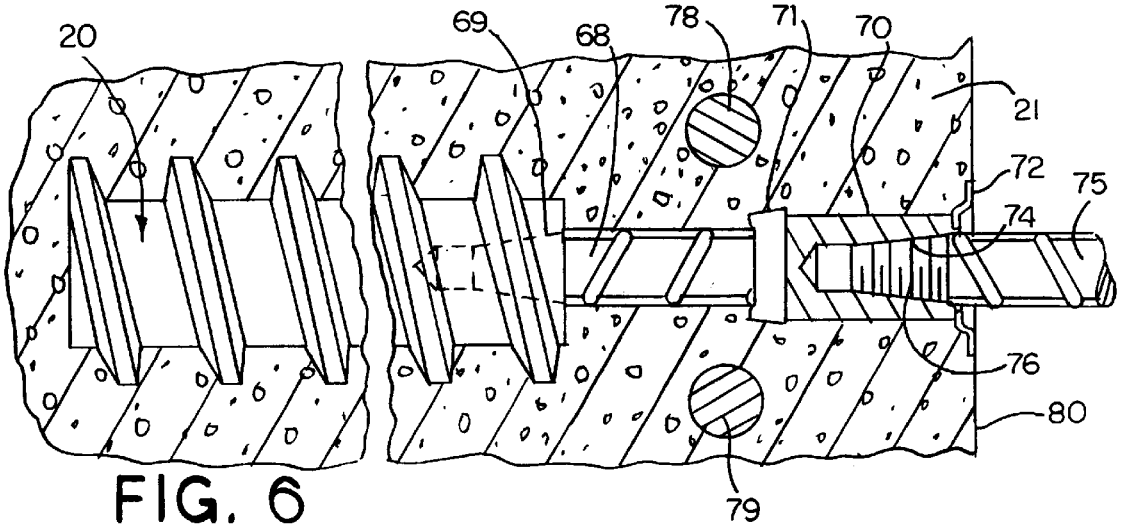
FIG. 6 is an illustration of the anchor spaced from the pour face to avoid bar congestion which may be near the face.

Referring now to FIG. 6, there is illustrated the same anchor 20 illustrated in FIG. 1 but secured to a relatively short section of bar 68 with the tapered thread connection 69. The short section of bar 68 is welded to an internally threaded socket 70 as indicated at 71. The socket 70 is provided with a mounting plate 72 to enable the entire assembly to be secured to the interior of a form. The assembly includes a cover plate protecting the threaded socket 74 which may be removed when the forms are removed exposing the threaded socket so that a bar 75 having external tapered threads 76 on the end may be secured in the socket with relatively few turns. The assembly seen in FIG. 6 may be utilized when reinforcing bar such as shown at 78 and 79 is congested near the concrete surface 80. Accordingly, if reinforcing bar congestion makes it difficult to use the anchor, the anchor may be positioned slightly spaced from the transition surface 80.

Figure 7:
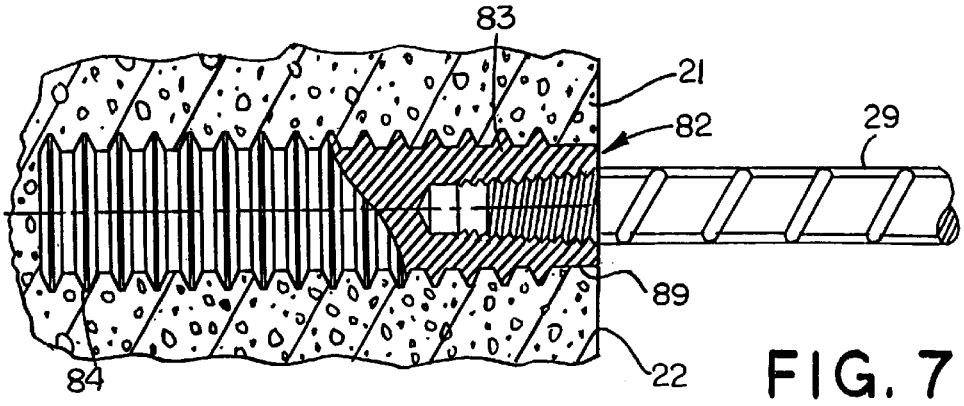
FIG. 7 is a view like FIG. 1 but of yet another embodiment and partly broken away and in section.

Referring now to FIG. 7, there is illustrated another form of anchor shown generally at 82. The anchor includes a core 83, and projecting therefrom, a series of equally spaced annular rings shown at 84. The profile or formation of the annular rings is similar to the helical flute or rib seen in FIG. 1. Preferably the exterior of the core at the threaded connection for the bar 29 has no ribs as indicated at 89. However, even though there is a substantial axial length of the core at the form not provided with deformations, nonetheless as illustrated fifteen full rings are provided in the same preferred axial length as indicated. Accordingly, the bonding area ratio to the core area is higher than the embodiment of FIG. 1, even though the ribs may have less height. The bond surface projections are spread uniformly axially of the anchor. The rod 29 is secured to the exposed end of the anchor at the concrete transition 22 by the same preferred tapered thread connection.

The tapered thread connection is preferred for several reasons. The proper connection may be accomplished by relatively few turns of the bar into the socket without the danger of cross threading. With a straight thread, cross threading is more of a problem, and it is difficult to start the thread connection, particularly if the bar is long. Thus, a single anchor may accommodate a range of bar sizes.

Figure 8:
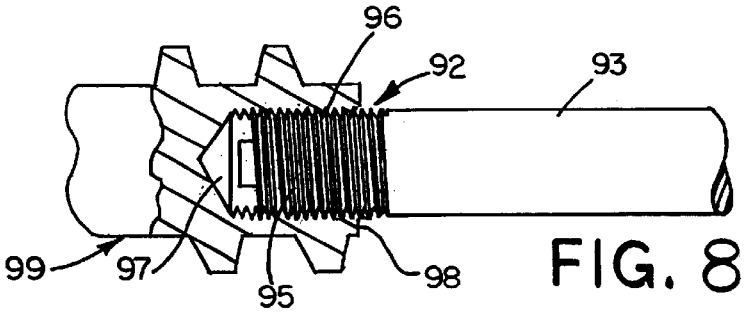
FIG. 8 is a fragmentary view like FIG. 2 but illustrating another form of threaded connection.

Nonetheless, the anchor of the present invention may utilize other types of thread connections such as the straight thread connection seen at 92 in FIG. 8. In FIG. 8, a bolt 93 is provided with straight or parallel threads 95 which mesh with matching parallel threads 96 on the interior of socket 97 in the end 98 of anchor 99. The bolt may be a reinforcing bar having an end which may be upset by hot or cold forging, and the formed threads may be larger than, or the thread profile may be on each side or straddle the nominal or largest diameter of the bar. Other types of parallel thread connections may also be employed with the anchor of the present invention.

Figure 9:
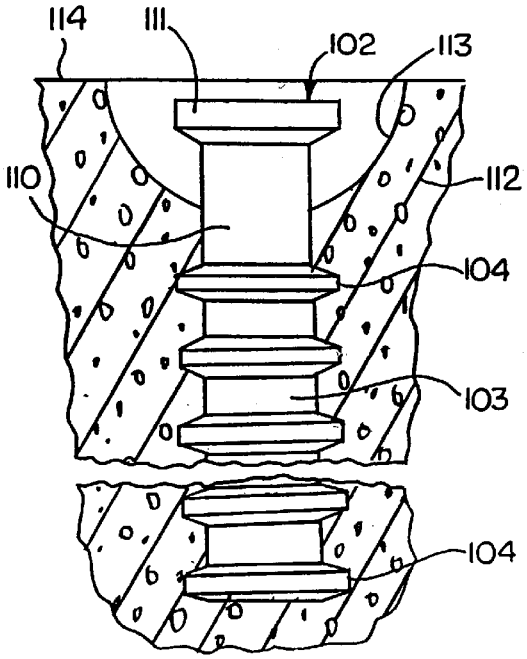
FIG. 9 is a fragmentary section illustrating the anchor in slightly modified form employed also as a lifting anchor for a precast concrete element.

Referring now to FIG. 9, there is illustrated a slightly modified anchor 102. The anchor includes a core 103 and deformation rings 104, which are equally spaced. The anchor includes a projecting core section 110 which has no deformation rings and terminates in head 111 which is spaced from the other deformations. The anchor is designed to be inserted in a precast concrete element 112 so that the head 111 projects into a hemispherical recess 113 extending from the surface 114 of the cast concrete element 112. In this manner, a lifting hook may readily be inserted beneath the head 111 in the hemispherical recess 113 to facilitate the lifting and movement of the concrete element. These types of anchors for the transportation of concrete elements are sold by Deha Ankersysteme GmbH & Co. KG of Germany, and an example may be seen in European Patent No. 0,088,825,A.

Figure 10:
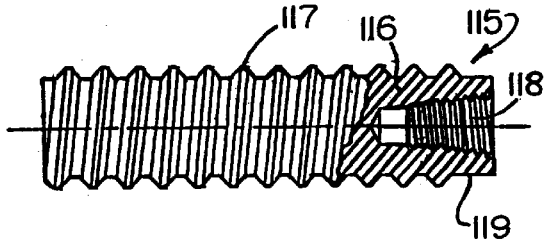
FIG. 10 is an elevation of a somewhat smaller anchor, partially broken away and in section.

In FIG. 10 there is illustrated an anchor 115 like the anchor 82 of FIG. 7. The anchor 115 includes a core 116, helical spiral flute 117, and a taper thread socket 118 in one end. The socket end also has a short undeformed section 119 at the socket end.

In comparing the anchors of FIGS. 7 and 10, it will be noted that the anchor of FIG. 10 may be somewhat shorter and smaller. While the size of the anchor is bar size dependent, the anchor length, for example, may vary from less than about 115 mm to about 160 mm. While FIG. 7 illustrates concentric rings, it will be appreciated that the preferred rib is a continuous helix as illustrated in FIG. 10 and in other embodiments. Whether a helix or rings, it will be seen that the anchor of FIG. 7 has sixteen turns, while the anchor of FIG. 10 has about twelve.

The flank of the ribs, rings or helix, may vary from about a 30° slope to about 45°. The height-pitch ratio is about 1 to 3.

As indicated, the area of the bonding surface facing axially is substantially larger than the area of the core. This can be calculated by subtrating the area of the core (at D1 in FIG. 3) from the over all area (at D2 in FIG. 3), and then multiplying by the number of turns.

An exemplary calculation is as follows. Using the scale of FIG. 2, D1 is about 22 mm and D2 is about 36 mm. The area of the two circles then becomes 380 $mm^2$ at D1 and 805 $mm^2$ at D2. The difference is 425 $mm^2$. If, for example, the anchor has an even minimum of five full turns, this produces an area of about 2125 $mm^2$, which is about five times the area of the core. However, the anchor will have normally considerably more turns.

This same calculation can be done for anchors like those of FIGS. 7 and 10. If the core has a diameter of 25 mm and with a rib height of 3 mm, then the overall diameter is 31 mm. The area of the core is 491 $mm^2$ The overall area is 754 $mm^2$. The difference is 263 $mm^2$, but the number of turns in FIG. 7 is fifteen, and accordingly the area facing axially is 3945 $mm^2$. Even at twelve turns in FIG. 10, the area is 3156 $mm^2$, or over six times the area of the core.

In some embodiments, the anchor will have a length of 115 to 160 mm, a 25 mm core diameter, a rib height of 3 mm, and a pitch of 10, providing at 160 mm about sixteen turns. The deformation area facing axially is from about five to in excess of seven times the area of the core. To be effective, the ratio should be from about 3 to about 8 or more and preferably from about 4 to about 7 or more. Also, the overall diameter should be from about 1.2 to about 2 times the diameter of the core. Anchorage lengths below 115 mm may be employed depending on diameter and rib height.

Figure 11:
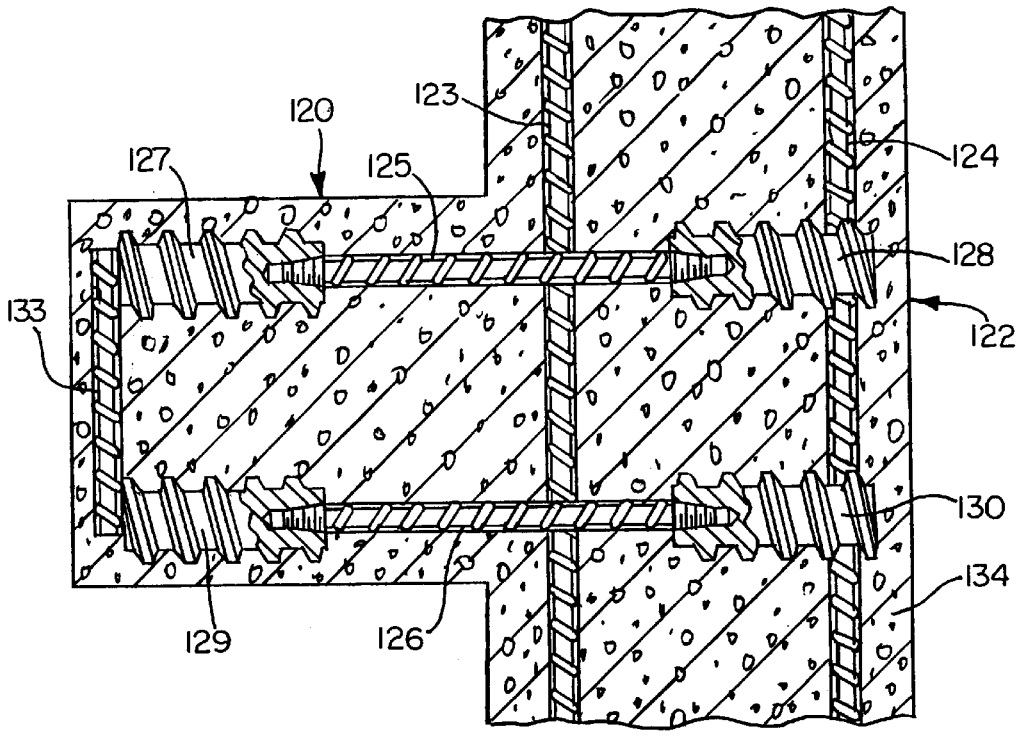
FIG. 11 is a fragmentary section through a corbel illustrating how the anchors may be used as bar end anchors in the construction and support of the corbel.

Referring now to FIG. 11, there is illustrated the anchor of the present invention utilized as bar terminations in the construction of a corbel shown generally at 120. The corbel projects in cantilever fashion from a vertical column or wall 122. The column includes its own reinforcing bar shown at 123 and 124. The corbel is formed top and bottom by relatively short sections of reinforcing bar seen at 125 and 126 having anchors of the present invention secured to each end as seen at 127 and 128 for the rod 125, and at 129 and 130 for the rod 126. The relatively short rod assemblies may be held in place by wire tying or suitable chairs or stools, and they may be vertically separated by a short section of vertical bar indicated at 133 secured between the outer ends of anchors 127 and 129. The steel bar reinforcement is then embedded in concrete 134.

Figure 12:
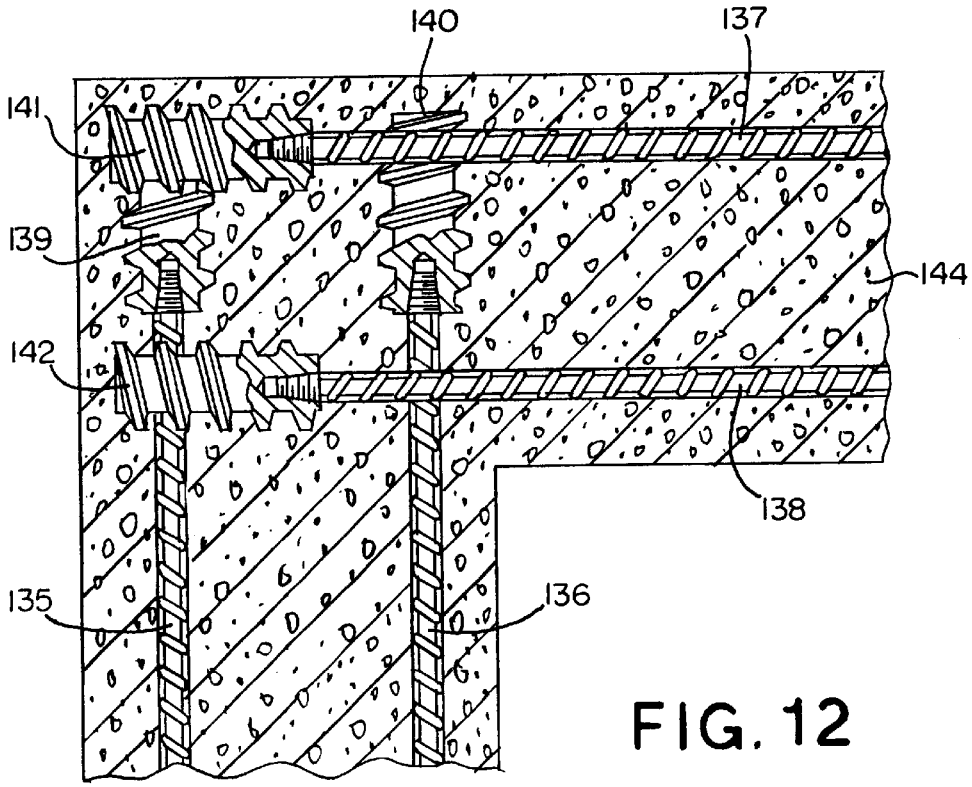
FIG. 12 is a similar section of a corner detail again illustrating the anchors used as bar end anchors.

In FIG. 12, there is illustrated a corner detail which may be taken on either a vertical or horizontal plane. The two arms of the corner are both formed by lengths of reinforcing bar seen at 135 and 136 for one arm of the corner and at 137 and 138 for the other arm of the corner. Each bar illustrated has an anchor in accordance with the present invention secured to the end thereof. The poured concrete 144 completely surrounds and embeds the bar and the respective anchors. It will also be appreciated that the corner illustrated in FIG. 11 may be reinforced by a diagonal short section of bar having anchors on both ends. The poured-in-place concrete constructions seen in FIGS. 10 and 11 enable the corbel or corner, respectively, to be formed quickly and easily without bar congestion and without complex placement problems which would delay and make more difficult the construction of the concrete sections shown.

It can now be seen that there is provided an anchor for steel reinforcing bar used in concrete construction which serves both as a bar termination and as a transition or starter bar anchor for use between pours or at forms for poured-in-place construction or at the surfaces of precast elements. The anchor includes a core, is of relatively short axial extent, and has substantial peripheral deformations which provide a large area bonding surface relative to the diameter or area of the core which extends continuously circumferentially and axially. Although tapered thread connections to the anchor are preferred, other forms of connections may be employed.

To the accomplishment of the foregoing and related ends, the invention then comprises the features particularly pointed out in the claims, these being indicative, however, of but a few of the various ways in which the principles of the invention may be employed.

What is claimed is:

1. A reinforcing bar anchor embedded in and bonded to concrete comprising an axially elongated generally cylindrical core, a socket in at least one end of said core, and a concrete reinforcing bar secured in said socket and fixed to said anchor so that said anchor is joined to said bar, said core having a transverse dimension of up to about three times the diameter of the bar, and rib means projecting radially and circumferentially from the core having an effective diameter larger than that of the core providing an axial facing area and an enhanced and an increased bonding surface for the core with a large cross-sectional area facing axially relative of the core and bonded to the concrete;

wherein said socket is internally threaded and said bar is externally threaded with matching threads;

wherein said axially facing area provided by said rib means is from about 3 to about 8 times the cross-sectional area of the core.

2. A reinforcing bar anchor as set forth in claim 1 wherein said rib means comprises one or more ribs projecting radially from the core about half the transverse dimension of the core.

3. A reinforcing bar anchor as set forth in claim 2 wherein said rib means is a single continuous helical rib.

4. A reinforcing bar anchor as set forth in claim 2 wherein said rib means is a plurality of axially spaced ribs.

5. A reinforcing bar anchor as set forth in claim 1 wherein said axially facing area provided by said rib means is from about 4 to about 7 times the cross-sectional area of the core.

6. A reinforcing bar anchor as set forth in claim 1 wherein said threads are tapered.

7. A reinforcing bar anchor as set forth in claim 1 wherein said rib means is a continuous helix and has a height projecting from the core about ⅓ its pitch.

8. A reinforcing bar anchor as set forth in claim 1 wherein said rib means has an axial spacing along said core of about 3 times its height.

9. A reinforcing bar anchor as set forth in claim 1 wherein said concrete has a surface, and said socket of said anchor is exposed to said surface so said reinforcing bar can be secured to said anchor at said exposed surface.

10. A reinforcing bar anchor as set forth in claim 1 including a socket in each end of said core, and a reinforcing bar secured in each socket so that said anchor joins each bar.

11. A reinforcing bar anchor embedded in and bonded to concrete comprising an axially elongated generally cylindrical core, a socket in at least one end of said core, and a concrete reinforcing bar secured in said socket and fixed to said anchor so that said anchor is joined to said bar, said core having a transverse dimension of up to about three times the diameter of the bar, and rib means projecting radially and circumferentially from the core having an effective diameter larger than that of the core providing an axial facing area and an enhanced and an increased bonding surface for the core with a large cross-sectional area facing axially relative of the core and bonded to the concrete, a hardenable flowable filler material in said socket securing the bar end to the anchor.

* * * * *